US007210745B2

(12) United States Patent
Ritchey

(10) Patent No.: US 7,210,745 B2
(45) Date of Patent: May 1, 2007

(54) RETAINER FOR CUTTING BIT

(75) Inventor: Cary D. Ritchey, Roaring Spring, PA (US)

(73) Assignee: Kennametal Inc., Latrobe, PA (US)

( * ) Notice: Subject to any disclaimer, the term of this patent is extended or adjusted under 35 U.S.C. 154(b) by 0 days.

(21) Appl. No.: 11/112,197

(22) Filed: Apr. 22, 2005

(65) Prior Publication Data

US 2006/0238016 A1 Oct. 26, 2006

(51) Int. Cl.
*E21C 35/19* (2006.01)

(52) U.S. Cl. ..... 299/107

(58) Field of Classification Search ..... D8/394, D8/395; 411/530, 517–519, 353, 539; 299/102–103, 299/106–110; 37/458–459; 403/154, 155, 403/317–318, 326, 372, 355

See application file for complete search history.

(56) References Cited

U.S. PATENT DOCUMENTS

| | | | | |
|---|---|---|---|---|
| RE18,144 | E | 8/1931 | Heiermann | |
| 2,805,584 | A | 9/1957 | Hinsey | |
| 3,690,728 | A | 9/1972 | Krekeler | |
| 3,752,515 | A | 8/1973 | Oaks et al. | |
| 3,910,566 | A * | 10/1975 | Pedersen et al. | 267/167 |
| 3,952,433 | A | 4/1976 | Heinold et al. | |
| 3,957,307 | A | 5/1976 | Varda | |
| 4,247,147 | A | 1/1981 | Rettkowski | |
| 4,404,760 | A | 9/1983 | Hahn et al. | |
| 4,505,058 | A | 3/1985 | Peterson | |
| 4,650,254 | A | 3/1987 | Wechner | |
| 4,684,176 | A | 8/1987 | Den Besten et al. | |
| 4,733,987 | A | 3/1988 | Tomlinson et al. | |

(Continued)

FOREIGN PATENT DOCUMENTS

| | | |
|---|---|---|
| DE | 2716177 | 10/1977 |
| GB | 2 079 350 A | 1/1982 |
| PL | 172654 | 9/1995 |
| WO | WO 2004/007111 A1 | 1/2004 |

OTHER PUBLICATIONS

Kennametal Inc. Catalog entitled "Construction Tools", 1997 pp. 1-20.

Kennametal Inc. Catalog entitled "Kennametal Mining Products", 1996 p. 11.

Rotor Clip Company, Inc.'s Catalog and Engineering Manuel entitled "Rotor Clip Retaining Rings", 1985-94 pp. 46-47.

Kennametal Inc. Catalog entitled "Chain and Wheel Trenching Tools", 1999 p. 20.

Kennametal Inc. Brochure "Introducing . . . TR1 and TR2 Retainers and Installation Tools" 2003 2 pages.

Internet Brochure printed Apr. 5, 2005 entitled "Whitesell, The Wireform Design Data Page" 3 pgs.

Oberg et al, "Machinery's Handbook 23rd Edition" pp. 704-705.

International Search Report and Written Opinion of the International Searching Authority, mailed Oct. 13, 2006, in PCT/US2006/013766, filed Apr. 13, 2006.

*Primary Examiner*—Sunil Singh
(74) *Attorney, Agent, or Firm*—Matthew W. Smith

(57) ABSTRACT

A retainer for use in conjunction with a cutting bit wherein the cutting bit includes a shank that contains a recess therein. The retainer includes a generally cylindrical retainer body that has opposite ends and a central longitudinal axis. The retainer body has a generally arcuate shape that defines an arc between the opposite ends thereof. The retainer body further includes at least one ear that projects in a radial outward direction. The retainer body is made from a material that has a grain direction wherein the direction of the grain runs generally parallel to the central longitudinal axis of the retainer body.

6 Claims, 5 Drawing Sheets

U.S. PATENT DOCUMENTS

| | | | |
|---|---|---|---|
| 4,763,956 | A | 8/1988 | Emmerich |
| 4,883,129 | A | 11/1989 | Lonn et al. |
| 5,011,229 | A | 4/1991 | O'Neill et al. |
| 5,529,384 | A | 6/1996 | Ojanen et al. |
| 5,690,393 | A | 11/1997 | Massa et al. |
| 5,720,528 | A | 2/1998 | Ritchey |
| 6,070,945 | A | 6/2000 | Ritchey et al. |
| 6,428,110 | B1 | 8/2002 | Ritchey et al. |
| 2005/0223556 | A1 | 10/2005 | Kikuchi et al. |

*cited by examiner

RETAINER FOR CUTTING BIT

BACKGROUND

Cutting bit assemblies for such applications as mining or road milling typically comprise a cutting bit, sometimes referred to as a cutting pick or cutting tool, rotatably mounted within a support block. The support block is, in turn, mounted onto a drum or other body, typically by welding, which is, in turn, driven by a suitable drive means. When a number of such support blocks carrying cutting bits are mounted onto a drum, and the drum is driven, the cutting bits will engage and break up the material (e.g., earth strata) to be mined or removed. The general operation of such a mining machine or construction machine (e.g., a road planing machine) is well known in the art.

Heretofore, various retainers have been proposed or used to mount a cutting bit, rotatable or otherwise, within a support block.

As one example of such a retainer, U.S. Pat. No. 4,505,058 to Peterson shows a retainer having two legs. This retainer is to be used in conjunction with a support block having a recess with specially configured sidewalls that cooperate with the bends in the retainer legs to hold the retainer in place.

As another example, U.S. Pat. No. 4,883,129 to Lonn et al. shows another retainer that overlaps a cutting bit shank and a support block along substantially the entire length of the retainer. This retainer provides a single, continuous shear zone along its entire length.

As still another example, U.S. Pat. No. 6,428,110 to Ritchey et al. discloses a retainer used to retain a cutting bit in a holder. The retainer is stamped out of a piece of sheet steel and is received within an annular grove adjacent to the axial rearward end of the cutting bit. Although this retainer functions in a satisfactory fashion, certain drawbacks occur because the retainer is stamped from sheet steel.

One drawback connected with the stamped retainer of U.S. Pat. No. 6,428,110 is the presence of jagged portions along all or part of the peripheral edge of the retainer. This jagged portion can occur due to tearing or shearing of the material (e.g., steel) during the stamping process. The presence of the jagged portion results in a less than desirable surface finish for the retainer. It would thus be desirable to provide a retainer that presents a surface that does not have jagged portions along its peripheral edge, but instead, has a smooth surface finish along its peripheral edge.

Another drawback connected with the stamped retainer of U.S. Pat. No. 6,428,110 is the presence of so-called "fall off" on the exterior edge of the projections (or ears) that project in a radial outward direction from the retainer body. More specifically, this "fall off" exists when the exterior edge of the projection is not substantially perpendicular to the front or rear surface of the retainer, but instead, has an angled orientation with respect to such surfaces. It would be desirable to provide a retainer that presents projections (or ears) that do not exhibit this "fall off", but instead, has projections that have an exterior edge that is generally perpendicular to the front and rear surfaces of the projection (or ear).

Still another drawback connected with the stamped retainer of U.S. Pat. No. 6,428,110 is the fact that the grain direction of the steel is dependent upon the direction in which the sheet steel is fed into the stamping press. The grain direction of the steel can run either parallel or perpendicular to the mouth opening of the retainer. It would thus be desirable to provide a retainer that has a consistent grain direction that runs in a direction that is generally parallel to the central longitudinal axis of the retainer body so that the grain direction in the retainer is consistent from part-to-part.

SUMMARY OF THE INVENTION

In one form thereof, the invention is a retainer for use in conjunction with a cutting bit wherein the cutting bit includes a shank that contains a recess therein. The retainer includes a generally cylindrical retainer body that has opposite ends and a central longitudinal axis. The retainer body has a generally arcuate shape that defines an arc between the opposite ends thereof. The retainer body further includes at least one ear that projects in a radial outward direction. The retainer body is made from a material that has a grain that runs in a direction generally parallel to the central longitudinal axis of the retainer body.

In still another form, the invention is a method of making a retainer for use in conjunction with a cutting bit wherein the cutting bit includes a shank that contains a recess wherein the steps comprising: providing a generally straight elongate retainer body having opposite ends and a central longitudinal axis, the retainer body being made from a material having a grain that runs in a direction generally parallel to the central longitudinal axis of the retainer body; bending the straight elongate retainer body into an arcuate shape; and swaging the arcuate retainer body so as to form at least one ear that projects in a radial outward direction.

In yet another form, the invention is a cutting bit assembly comprising a cutting bit that has an elongate cutting bit body with an axial forward end and an axial rearward end. The cutting bit body contains a groove adjacent the axial rearward end thereof. The cutting bit assembly further includes a holder that has a central bore that has a forward end and a rearward end. The cutting bit is positioned within the central bore of the holder so as to extend past the rearward end of the bore thereby exposing the groove. A retainer is received within the groove. The retainer comprises a generally cylindrical retainer body that has opposite ends and a central longitudinal axis. The retainer body has a generally arcuate shape defining an arc between the opposite ends thereof. The retainer body further includes at least one ear projecting in a radial outward direction. The retainer body is made from a material having a grain that runs in a direction generally parallel to the central longitudinal axis of the retainer body.

BRIEF DESCRIPTION OF DRAWINGS

The following is a brief description of the drawings that form a part of this patent application.

DESCRIPTION OF A SPECIFIC EMBODIMENT

Figure 1:
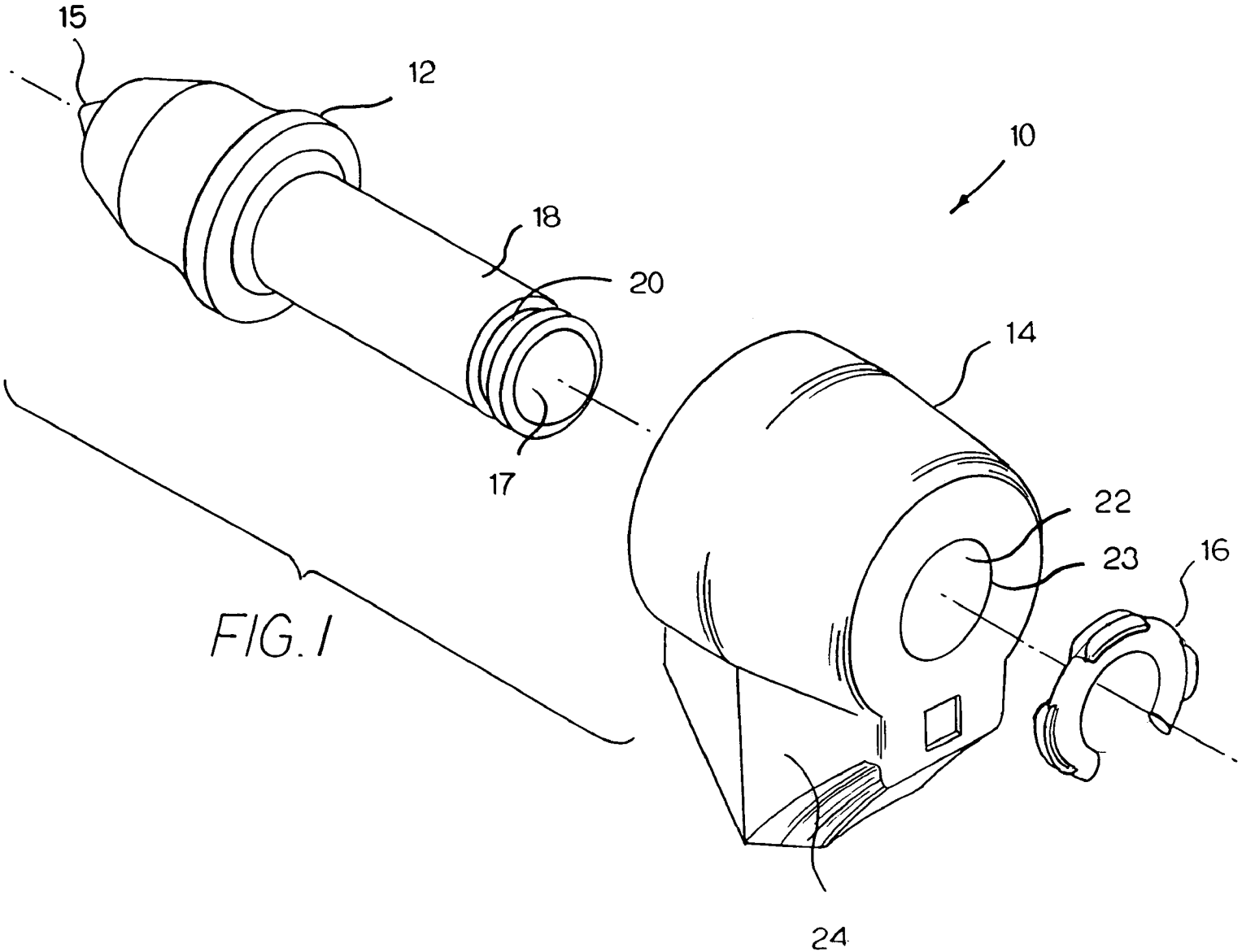
FIG. 1 is an exploded isometric view of a cutting bit assembly including a cutting bit, a holder (or support block) and a specific embodiment of a retainer.
Figure 2:
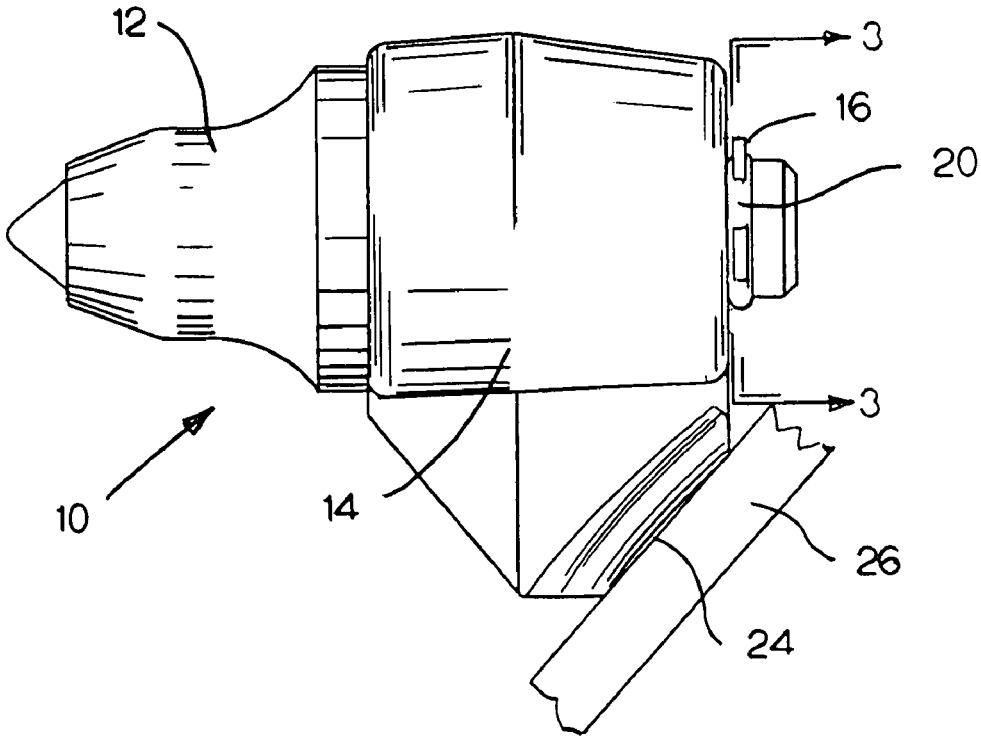
FIG. 2 is a side view of the cutting bit assembly as illustrated in FIG. 1, but with the components, including the cutting bit, the holder and the retainer, assembled together.

Referring to the drawings, FIGS. 1 and 2 show a cutting bit assembly 10 that comprises a cutting bit 12, a support block 14 and a retainer 16 according to the invention. The cutting bit 12 has an elongate cutting bit body that has a forward end 15 and a rearward end 17. The cutting bit body also has a cylindrical shank 18 that contains an annular groove or recess 20 therein adjacent to the rearward end 17 of the cutting bit body. As described hereinafter, the groove 20 is adapted to receive the retainer 16.

The support block 14 has a cylindrical bore 22 that receives the shank 18 of the cutting bit 12. The bore 22 has a forward end (not illustrated) and a rear end 23. The support block 14 has a base 24 that can be welded or otherwise attached to a track pad 26 of a trenching machine (not illustrated) used to break up material (e.g., earth strata).

When the trenching machine drives the track pad, the cutting bit 12 will engage and break up material to be broken and mined or otherwise removed. Alternatively, the support block 14 may be welded or otherwise attached to a driven rotatable drum (not illustrated) or any other suitable component of a mining machine or a road planing machine wherein during operation the cutting bits engage and break up the earth strata such as coal in the case of a mining machine or asphaltic material in the case of a road planing machine.

Figure 3:
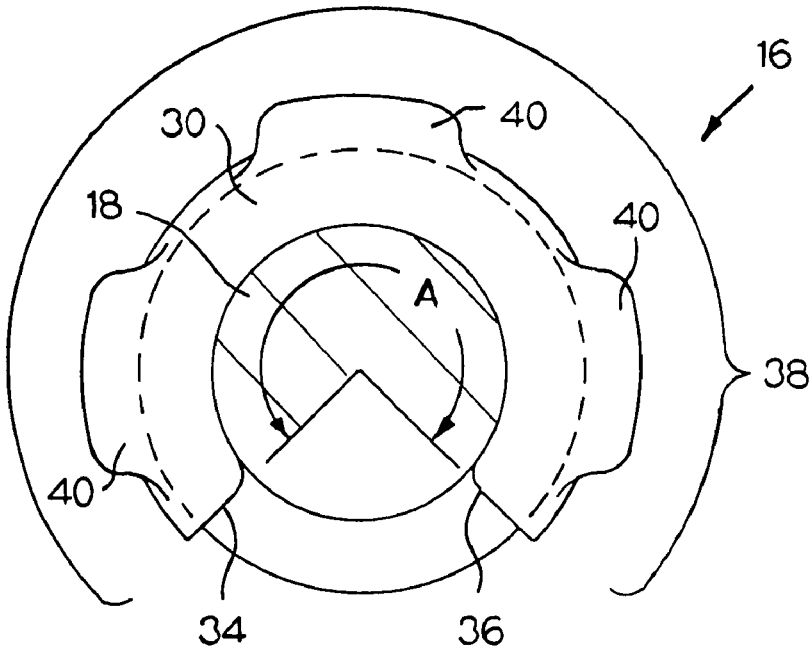
FIG. 3 is a cross-sectional view taken along section line 3—3 of FIG. 2 showing the retainer and the shank of the cutting bit
Figure 4:
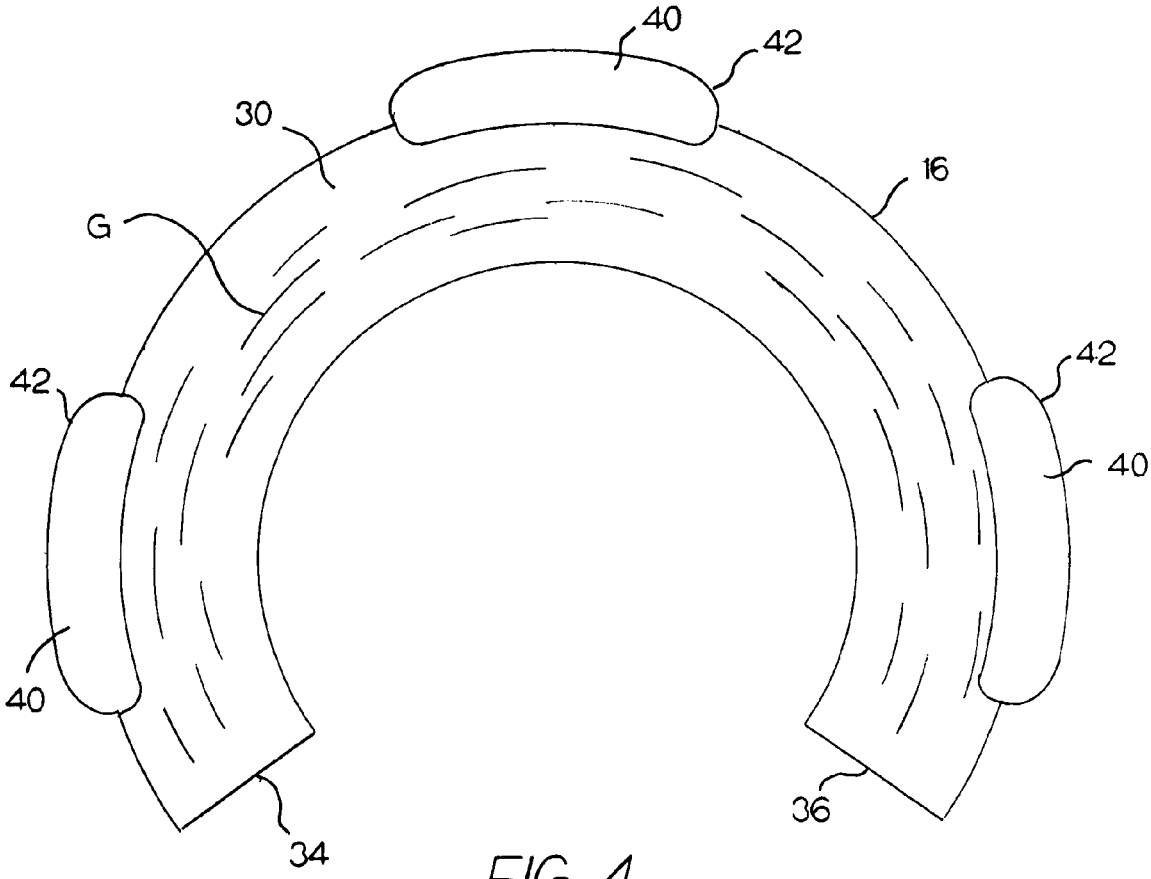
FIG. 4 is a front view of the retainer as illustrated in FIG. 1 wherein the grain direction is shown as running in a direction that is generally parallel to the central longitudinal axis of the retainer body.
Figure 7A:
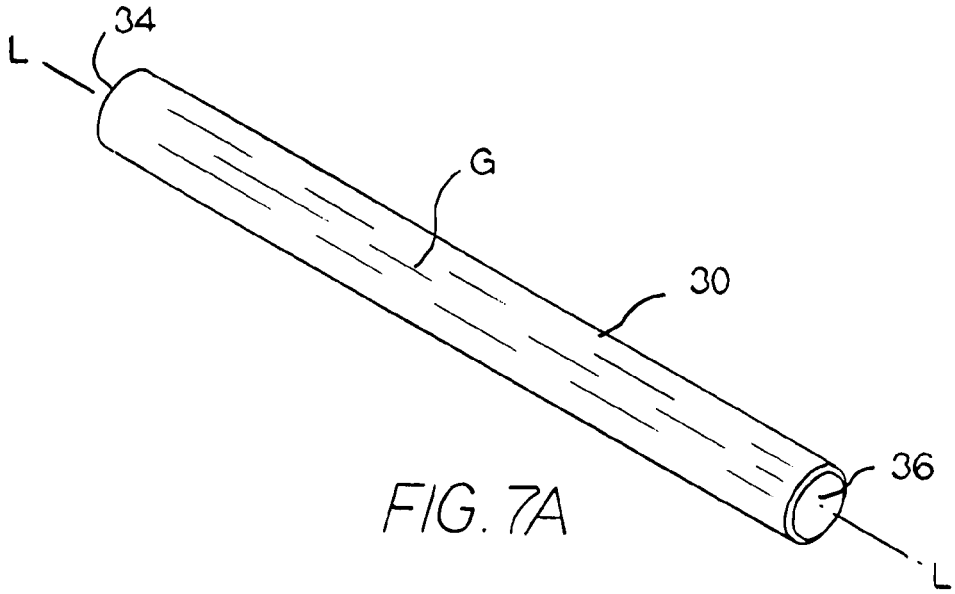
FIG. 7A is an isometric view of a piece of cylindrical wire that will be made into the retainer wherein the grain of the material is along the central longitudinal axis of the cylindrical wire.
Figure 7B:
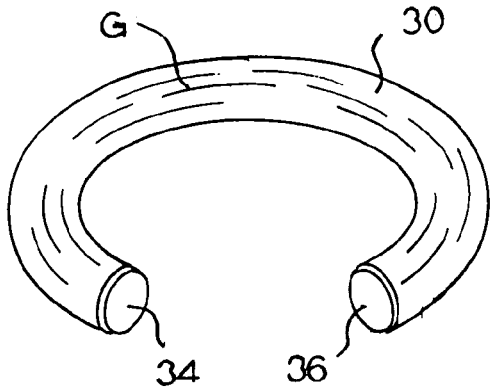
FIG. 7B is an isometric view of the cylindrical wire of FIG. 7A after being bent (or formed) around a cylindrical mandrel (not illustrated) so that the cylindrical wire takes on an arcuate (or generally circular) shape.
Figure 7C:
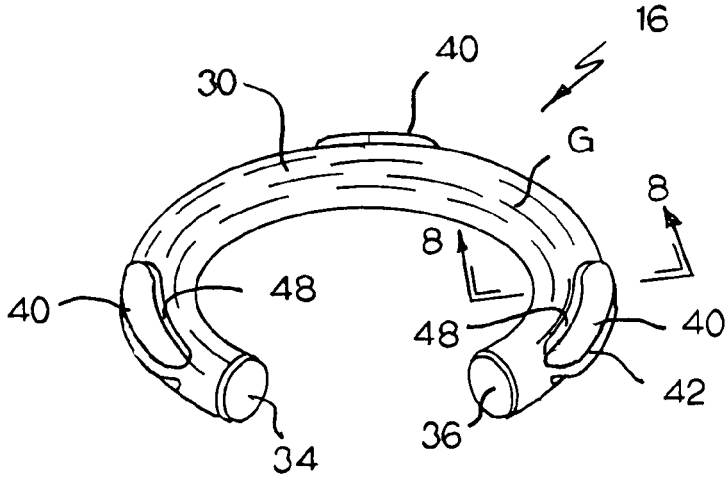
FIG. 7C is an isometric view of the cylindrical wire of FIG. 7B after it has been subjected to a swaging step that forms the ears that project in a radial outward direction from the retainer body.

Referring to FIGS. 3, 4 and 7C, the retainer 16 has a generally cylindrical retainer body 30 that is generally circular in cross-section. The retainer body 30 comprises a segment of a cylindrical wire that has been cut to a specific length and then fashioned into the retainer 16 as described hereinafter. The retainer body 30 presents a generally circular (or arcuate) geometry and has first and second opposite ends 34 and 36. The arcuate retainer body 30 defines an arc preferably extending through an angle "A" of at least one hundred eighty degrees. In the specific embodiment shown in the drawings, the arcuate retainer body 30 defines an arc extending through an angle "A" (see FIG. 3) of about two hundred seventy degrees.

When taken in conjunction with its cooperation with the annular groove 20 in the shank 18 of the cutting bit 12, the retainer body 30 also defines a continuous shear zone 38 preferably, but not always necessarily, along the entire length of the arc as defined by angle "A". Referring especially to FIG. 3, the term "shear zone" as used in this patent application means that portion of the retainer body 30 that overlaps both the shank 18 and the support block 14 when the retainer 16 is installed on (i.e., carried in the annular groove 20 in) the shank 18. Preferably, the continuous shear zone 38 extends through an angle in the range of between about thirty degrees to about three hundred degrees. More preferably, the continuous shear zone 38 extends through an angle of at least about one hundred eighty degrees, and has first and second ends that are the same as (i.e., coextensive with) the first and second ends 34 and 36, respectively, of the retainer body 30.

In the specific embodiment illustrated in FIG. 3, the continuous shear zone (illustrated by bracket 38) extends through an angle of about two hundred seventy degrees, and shear zone 38 has first and second ends that are the same as (or coextensive with) the first and second ends 34 and 36, respectively, of the retainer body 30. Alternatively, even though not illustrated, applicant contemplates that one or both ends 34 and 36 of the retainer body 30 may extend beyond one or both ends, respectively, of the continuous shear zone 38.

Referring especially to FIGS. 3, 4, 7C and 8, the retainer body 30 further includes one or more protruding portions (or ears) 40 that extend in a radial outward direction from the exterior surface of the retainer body 30. When the retainer 16 is received within the groove 20, these ears 40 extend in a radial direction past the shank 18 of the cutting bit 12 so as to be exposed and accessible for engagement by an installation tool 46 (as described hereinafter in conjunction with FIGS. 5 and 6) or the like. While the ears 40 may take on any suitable configuration, each protruding ear 40 is preferably a solid projection, and even more specifically, each ear 40 presents a generally rectangular shape. Each ear 40 also has an axially extending outer peripheral surface 42 that may be engaged by the installation tool 46. Installation tool 46 is along the lines of the installation tool for the TR1 and TR2 retainers shown in a Kennametal advertisement entitled "TR1 and TR2 Retainers and Installation Tools" [B03-22 (0.2)F3]. Another example of an installation tool is the puller that is shown and described in U.S. Pat. No. 6,428,110 to Ritchey et al., wherein such patent to Ritchey et al. is hereby incorporated by reference herein.

Figure 5:
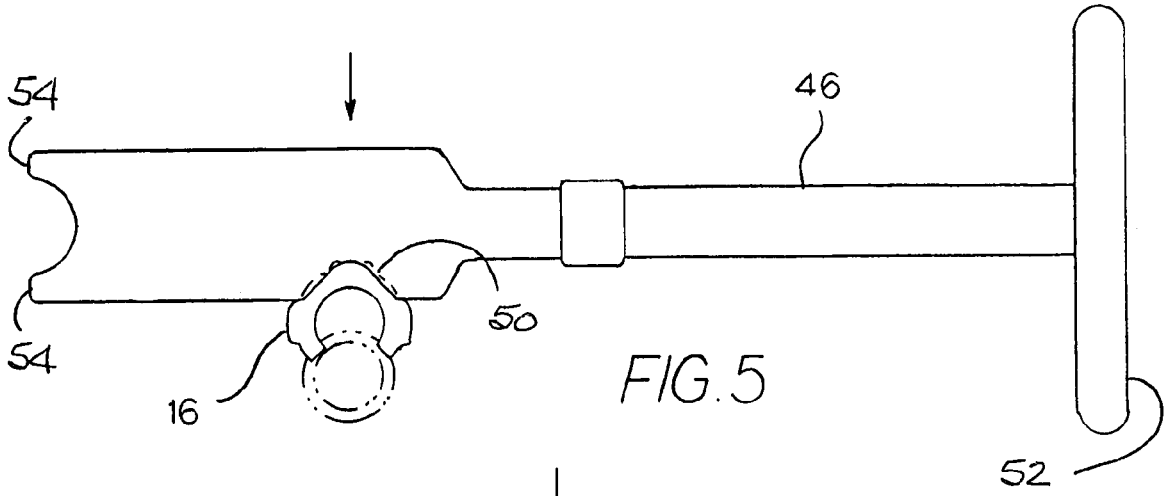
FIG. 5 is a rear view of the tool used to install and remove the retainer wherein the retainer is shown as being positioned in the magnetic notch of the tool so that the retainer may be installed on the cutting bit.
Figure 6:
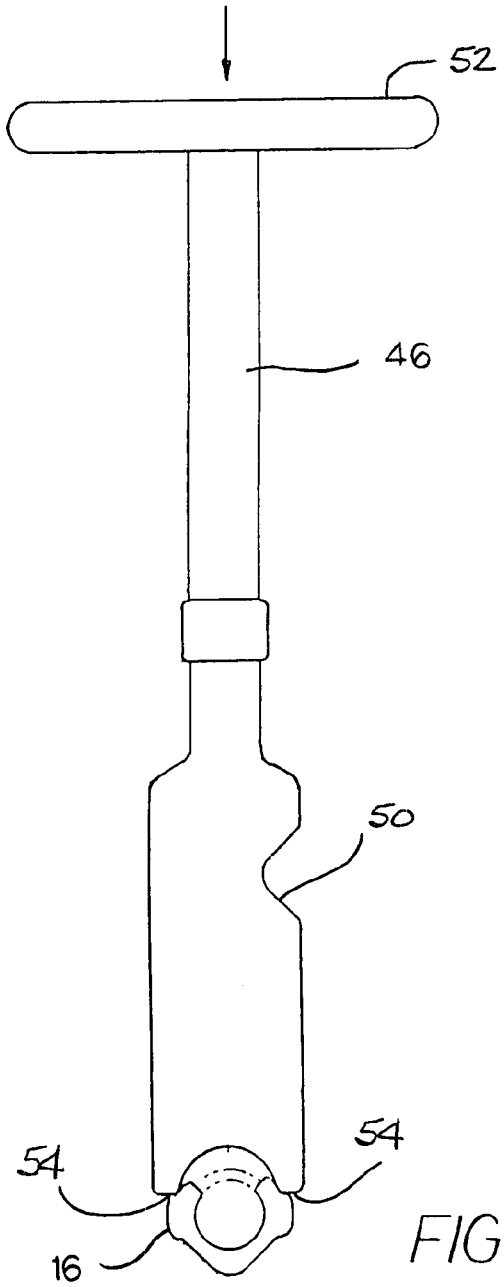
FIG. 6 is a rear view of the tool used to install and remove the retainer wherein the prongs of the tool are aligned with the opposite ends of the retainer so that the retainer may be removed from the recess in the shank of the cutting bit.

Referring to FIGS. 5 and 6, in order to use the retainer 16 of this invention, the cylindrical shank 18 of the cutting bit 12 is inserted into the bore 22 of the support block 14 such that the axial rear end of the shank 18 extends past the rear end of the bore 22 so that the recess 20 is exposed. The cutting bit 12 is now ready to receive the retainer 16.

In order to install the retainer 16 in the recess 20, as illustrated in FIG. 5, the retainer 16 is positioned on the puller 46 so that the retainer 16 is in the magnetic notch 50. The notch 50 engages at least one of the ears 40 of the retainer 16. The magnetic notch 50 holds the retainer 16 in place during the installation operation. Typically, the operator then strikes the rear end 52 of the installation tool 46 with a hammer with sufficient force so as to seat the retainer 16 in the recess 20.

When the retainer 16 is installed in the groove 20 contained in the shank 18, the retainer 16 contacts the surfaces that define the annular recess 20 to impede transverse movement of the retainer 16 relative to the shank 18. Alternatively, the retainer 16 may be installed on the shank 18 in any suitable manner.

In order to remove the retainer 16 from the recess 20, as illustrated in FIG. 6, the prongs 54 of the installation tool 46 are aligned against the opposite ends of the retainer 16. The operator then strikes the rear end 52 of the installation tool 46 so as to exert a force on the retainer 16 that is large enough to remove the retainer 16 from the recess 20.

Another method to remove a retainer from a recess in the shank of the cutting bit is shown and described in U.S. Pat. No. 6,429,110, which has already been incorporated by reference herein. Alternatively, the retainer 16 may be removed from the recess 20 in any suitable manner. For example, one of the ears 40 may be grasped by a suitable tool, such as a pair of pliers, so as to pull the retainer 16 away from the recess 20.

Because the continuous shear zone (illustrated by bracket 38) preferably extends the entire length of the retainer body 30, the retainer 16 has significant strength and durability characteristics. Furthermore, the engagement of the retainer 16 by the installation tool 46 enables the retainer 16 to be easily installed on and removed from the shank 18 as described hereinabove.

It can thus be seen that during operation, the cutting bit 12 is free to rotate relative to the holder 14 and thereby function to engage and break up the earth strata. However, it is also apparent that the retainer 16, which is received within the groove 20, securely retains the cutting bit 12 within the bore 22 of the holder 14. It is also apparent that the retainer 16 can be easily installed and removed through the use of the puller 46 or some other suitable tool so as to decrease the amount of downtime experienced by the machine operator during the replacement of the cutting bits.

In regard to method of making the retainer 16 and referring to FIGS. 7A through 7C, the retainer body 30 is made from a piece of generally cylindrical wire, i.e., the wire has a generally cylindrical cross-section and a central longitudinal axis L—L. One suitable material from which the retainer 16 is made is 1050 spring steel. FIG. 7A shows that the grain "G" of the material (e.g., steel) that comprises the wire runs in the same direction as (or is generally parallel to) the central longitudinal axis L—L of the cylindrical wire.

Referring to FIG. 7B, the cylindrical wire shown in FIG. 7A is then bent (or formed) over a cylindrical mandrel (not illustrated) so as to form the basic annular (or circular) geometry of the retainer 16. It can be appreciated that the direction of the grain "G" of the retainer 16 is always along the central longitudinal axis L—L of the retainer body 30. As a result, the direction of the grain "G" in the retainer body 30 will be uniform from part to part.

Referring to FIG. 7C, the ears 40 are then swaged or formed from the annular retainer body 30 as shown in FIG. 7B so as to result in the retainer 16 as illustrated in FIG. 7C. In regard to the swaging step, the material that forms the ears 40 comes from the retainer body 30. As a result, the ear 40 originates at a point slightly radial inward of the surface of the retainer (see FIG. 8) and terminates at its outer edge 42 at a point radial outward of the exterior surface (see FIG. 8). As is illustrated in FIG. 8, the ear 40 originates at a point that is a distance "B" radial inward of the retainer surface and terminates a distance "C" from the retainer surface.

Figure 8:
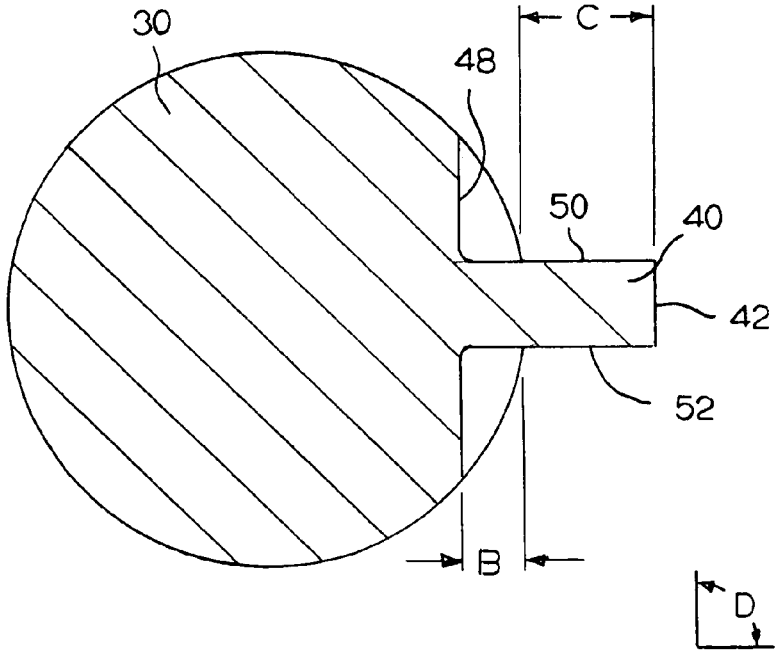
FIG. 8 is a cross-sectional view of the retainer of FIG. 7C taken along section line 8—8 in FIG. 7C.

Referring especially to FIGS. 7C and 8, there is a notch 48 at each location where the ears 40 project from the retainer body 30. This notch 48 is due to the fact that during the swaging step, the material that comprises the ear 40 was taken from the retainer body 30 thereby leaving the notch 48.

It can be seen that the surface of the retainer body 30 is smooth and consistent since the retainer body 30 is made from a cylindrical wire. Although not intended to be restrictive, the surface roughness ($R_a$) of the cold drawn wire is equal to about 125 microinches. Further, it can be seen, especially by FIG. 8, that the outer edge 42 of each ear 40 is generally perpendicular (see angle "D") to the front surface 50 and rear surface 52 of the ear 40.

The fact that the outer edge 42 is perpendicular to the front and rear surfaces of the ear 40 results in a more consistent engagement between the ears 40 and the notches in the puller 46 as compared to a stamped retainer wherein there is "fall off" at the outer edge of the ears. Further, the fact that the surface of the retainer 16 is smooth and consistent results in a more consistent engagement of the retainer 16 by the puller 46 as compared to the stamped retainer that has jagged edge portions. A more consistent engagement between the retainer and the puller provides for more efficient and improved installation and removal of the retainer 16.

The fact that the retainer 16 made from a cylindrical wire that has a grain "G" that runs in a direction generally parallel to the central longitudinal axis of the retainer body results in better consistency between each part as compared to a retainer that is stamped from sheet steel. It is desirable to provide a method that makes the retainer 16 with a part-to-part consistency that has heretofore not been available.

It can thus be appreciated that the present invention defines a retainer that exhibits new and improved properties. More specifically, the retainer of the present invention present a surface that does not have jagged edges, but instead, has a smooth surface finish. Further, the retainer presents projections (or ears) that do not exhibit the "fall off", but instead, are generally perpendicular to the surface of the face of the projection (or ear). Finally, the retainer that has a consistent grain direction wherein the grain runs in a direction along the length, i.e., along the central longitudinal axis, of the retainer body. This feature provides an improved part-to-part consistency in the manufacture of the retainers.

The patents and other documents identified herein are hereby incorporated by reference herein.

While embodiments of the invention have been illustrated and described, it is not intended that these embodiments illustrate and describe all possible forms of the invention. Other embodiments of the invention will be apparent to those skilled in the art from a consideration of the specification or a practice of the invention disclosed herein. Various changes may be made without departing from the spirit and scope of the invention, which is indicated by the following claims.

What is claimed:

1. A retainer for use in conjunction with a cutting bit wherein the cutting bit includes a shank that contains a recess therein, the retainer comprising:

a generally cylindrical retainer body having opposite ends and a central longitudinal axis, and the retainer body having a generally arcuate shape defining an arc between the opposite ends thereof;

the retainer body further including at least one generally rectangular ear, formed from the annual retainer body, projecting in a radial outward direction from the retainer body, wherein the ear presents a forward surface and a rearward surface and an outer edge, and the outer edge being generally perpendicular to the forward surface and the rearward surface; and the retainer body being made from a material having a grain that runs in a direction generally parallel to the central longitudinal axis of the retainer body.

2. The retainer of claim 1 wherein the retainer body including a trio of ears.

3. The retainer of claim 1 wherein the retainer body presents a generally smooth exterior surface.

4. A cutting bit assembly comprising:

a cutting bit having an elongate cutting bit body with an axial forward end and an axial rearward end, the cutting bit body containing a groove adjacent the axial rearward end thereof;

a holder having a central bore having a forward end and a rearward end;

the cutting bit being positioned within the central bore of the holder so as to extend past the rearward end of the bore thereby exposing the groove;

a retainer being received within the groove;

the retainer comprising a generally cylindrical retainer body having opposite ends and a central longitudinal axis, and the retainer body having a generally arcuate shape defining an arc between the opposite ends thereof;

the retainer body further including at least one generally rectangular ear, formed from the annual retainer body, projecting in a radial outward direction from the retainer body, wherein the ear presents a forward surface and a rearward surface and an outer edge, and the outer edge being disposed at about ninety degrees to the forward surface and the rearward surface; and the retainer body being made from a material having a grain direction wherein the direction of the grain runs generally parallel to the central longitudinal axis of the retainer body.

5. The cutting bit assembly of claim 4 wherein the retainer body including a trio of ears.

6. The cutting bit assembly of claim 4 wherein the retainer body presents a generally smooth exterior surface.

* * * * *